United States Patent [19]

Taylor

[11] 4,432,136

[45] Feb. 21, 1984

[54] RAZOR AND HANDLE COUPLING MEANS

[75] Inventor: John B. Taylor, Reading, England

[73] Assignee: The Gillette Company, Boston, Mass.

[21] Appl. No.: 387,584

[22] Filed: Jun. 11, 1982

[30] Foreign Application Priority Data

Jun. 22, 1981 [GB] United Kingdom ..... 8119146

[51] Int. Cl.[3] ..... B26B 21/00

[52] U.S. Cl. ..... 30/32; 30/90

[58] Field of Search ..... 30/32, 47, 40.2, 90; D28/46, 48; 206/510, 504, 372; 220/23.6, 23.4; 403/397

[56] References Cited

U.S. PATENT DOCUMENTS

D. 248,878 8/1978 Halm ..... D28/48
4,212,103 7/1980 Schuman-Hoole ..... 30/32
4,309,821 1/1982 Terry et al. ..... 30/32

FOREIGN PATENT DOCUMENTS 1473527 2/1967 France ..... 30/32
1557818 12/1979 United Kingdom ..... 30/32

*Primary Examiner*—E. R. Kazenske
*Assistant Examiner*—Douglas D. Watts
*Attorney, Agent, or Firm*—Raymond J. De Vellis

[57] ABSTRACT

A disposable safety razor is provided with coupling means by which a plurality of such razors can be assembled into a stack, one behind another. Each razor handle is formed with a downwardly directed hook and an upwardly directed hook on its front and rear faces, respectively, and with a resilient latch member formed by a resilient arm extending downwardly and rearwardly of the handle and spaced from the hooks and terminating at a catch. The handle also has a ledge formed at the same level as the catch. Two adjacent razors are firmly but releasably coupled together by interengagement of the respective hooks and of the catch with its ledge. The resilient arm yields to permit deliberate disengagement of the catch from the ledge, permitting, in turn, disengagement of the hooks.

3 Claims, 3 Drawing Figures

RAZOR AND HANDLE COUPLING MEANS

BACKGROUND OF THE INVENTION

This invention relates to safety razors, and more particularly to safety razors of the disposable variety in which the shaving head is permanently united with the handle, and the razor is discarded as a whole when its cutting edge or edges have become dulled.

For convenience of packaging transit and storage, U.S. Pat. No. 4,212,103 proposes to nest two identical razors within each other. French Patent No. 1,473,527 proposes the stacking of disposable razors. Forming the handles of razors with respective projections and cooperating slots so that two razors can be held together, one behind the other by frictional engagement of the projections in the slots, has also been proposed in U.S. Pat. No. 4,309,821 and British Patent No. 1,557,818.

The integrity of an assembly or "stack" of razors of such forms relies, if at all, entirely on friction fit. The present invention provides an improved form of coupling which is more positive in its retention of one razor to another. Further the present invention has the advantage that if its two coupled razors are partially separated, for example as a result of accidental impact, they tend to restore themselves to their correct positional relationship.

SUMMARY OF THE INVENTION

In a presently preferred embodiment of the invention, this is achieved by the provision, on each razor handle of coupling means comprising, on the one hand a first upwardly directed hook and a second downwardly directed hook positioned to be interengaged with the first hook of an adjacent razor, and on the other hand with a resilient latch member and a ledge engageable by the corresponding latch member of an adjacent razor handle, the ledge being spaced along the handle from the first and second hooks, and the latch acting to hold the handles together when engaged with the ledge, but resiliently yieldable to permit deliberate separation of the handles.

BRIEF DESCRIPTION OF THE DRAWINGS

The invention both as to its organization and principles of operation, together with further objects and advantages may be better understood by referring to the following detailed description of an embodiment of the invention when used in conjunction with the accompanying drawing in which.

DESCRIPTION OF A PREFERRED EMBODIMENT

Figure 1:
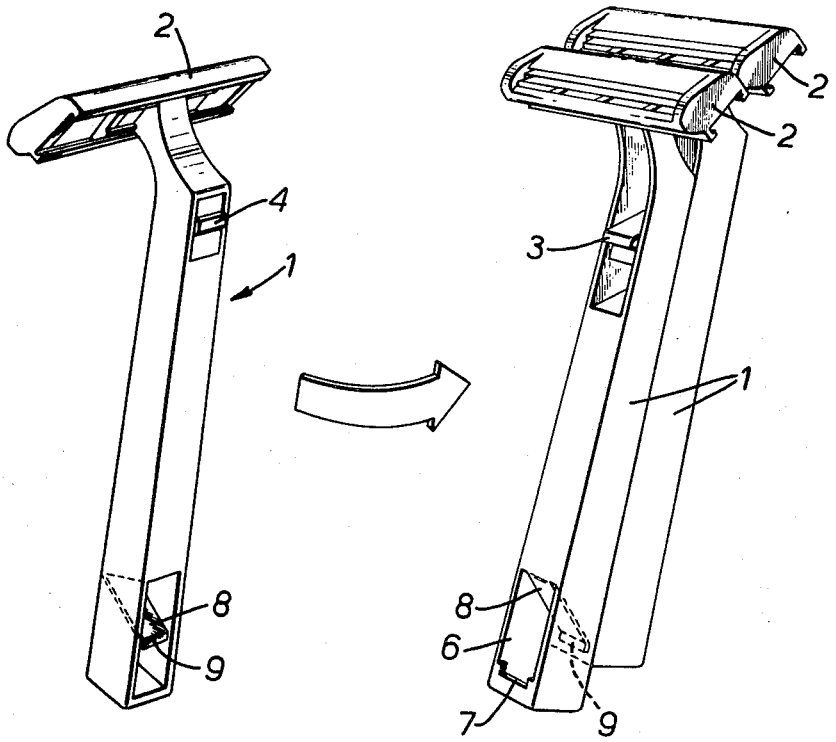
FIG. 1 is a diagrammatic perspective view of a plurality of razors, in accordance with the invention.

All of the razors shown in the drawings are of identical form, each comprising an elongated handle 1 and an transversely extending shaving head 2 integrally united to the top of the handle. The construction of the shaving head is well known in the art. Near its upper end, the front face of the razor handle is formed with a downwardly directed hook 3, and on its rear face with an upwardly directed hook 4. The hooks 3 and 4 of adjacent handles are adapted to make snug-fitting interengagement with each other. When so engaged, the hooks 3 and 4 hold the upper ends of the two handles in abutting engagement with each other.

Near the lower end of the handle, the front face is formed with a recess 6, the bottom forward lower edge of which is defined by a ledge 7, and extending rearwardly and downwardly from a position above the ledge 7 is a resilient latching finger 8 which has a downturned catch or latch portion 9 at its free outer end.

Figure 2:
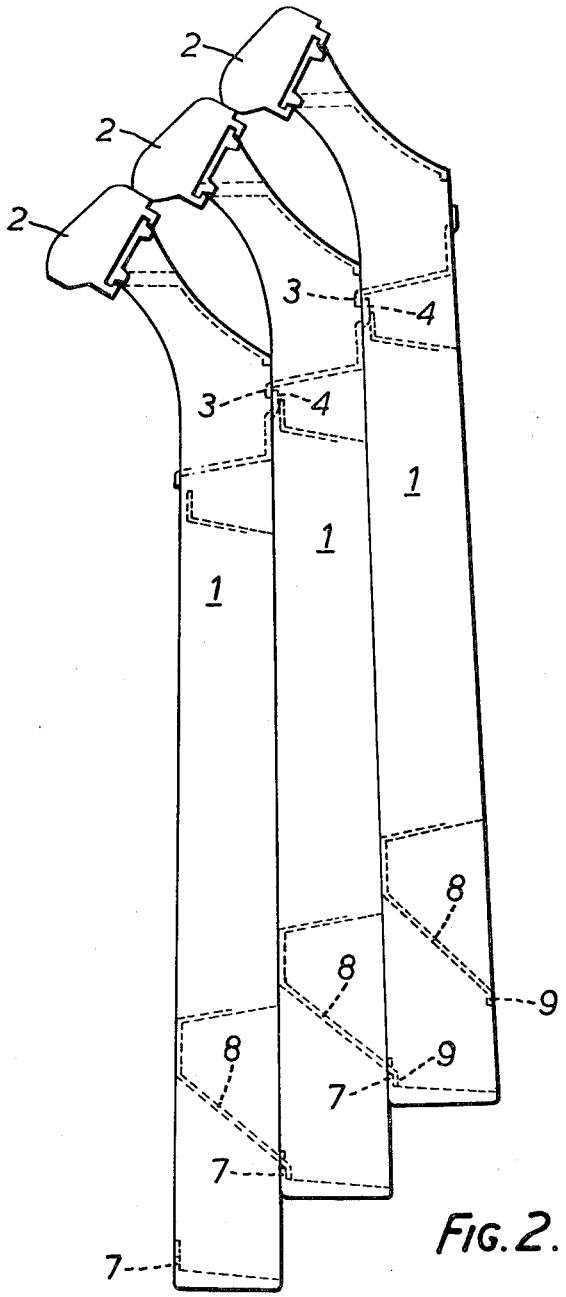
FIG. 2 is a diagrammatic side view of a stack of three razors, in accordance with this invention.

FIG. 2 shows how the finger 8 extends rearwardly with its portion 9 latched over the ledge 7. Ledge 7 is formed at the same level as the latch portion 9. In this condition the finger 8 is strained rearwardly, and so acts to hold the lower ends of adjacent handles in abutting relationship.

The upper ends of the handles are positively coupled by the interengaged hooks 3 and 4. In the event of the lower ends of the handles being partially separated, for example due to impact, the spring latch members tend to restore the handles to their intended, illustrated positions.

To separate a razor from its adjacent razor, the user pulls the lower ends of the handles apart sufficiently for the latch portion 9 to clear the ledge 7, whereupon the spring finger 8 recovers resiliently, and uncoupling is completed by a short relative vertical movement to disengage the hooks 3 and 4 and to permit the complete separation of the two razors. It would alternatively be possible to arrange for the spring finger 8 to exceed its elastic limit and snap off during deliberate separation.

Figure 3:
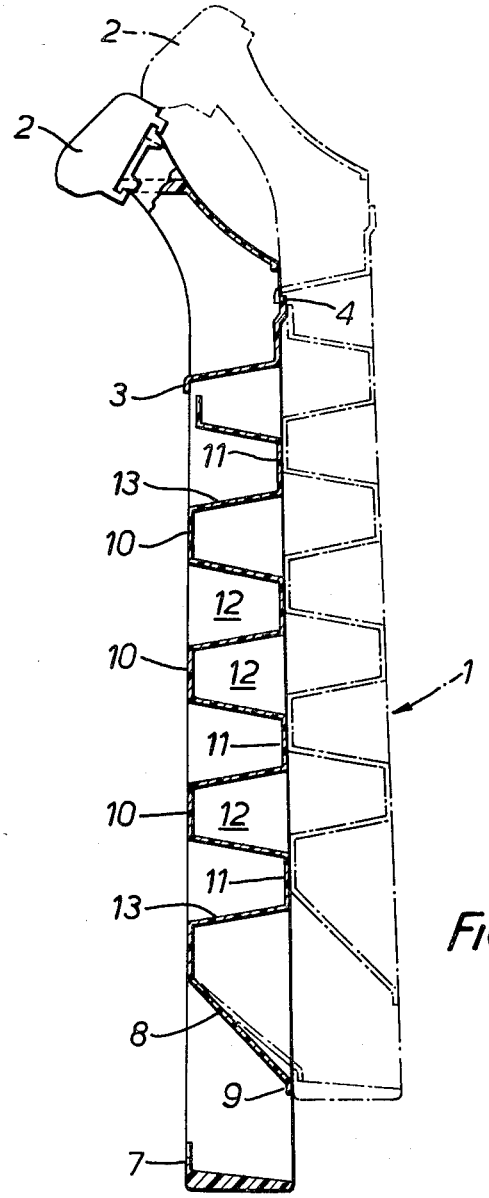
FIG. 3 is a cross-sectional elevation of the razor handle of the razors of FIGS. 1 and 2 but drawn to a larger scale, in accordance with this invention.

Whereas FIGS. 1 and 2 are somewhat diagrammatic, FIG. 3 is a true section of the handle which is molded to have a pair of continuous, solid side walls interconnected by transverse webs effectively forming discrete front and rear wall surfaces 10, 11 respectively alternating with pockets 12 bounded from above and below by transverse webs 13.

FIG. 3 also illustrates the form of the first and second hooks 3 and 4 and shows the finger 8 in its free or "as molded" condition. A second razor handle is shown in phantom line in the position it occupies when coupled to the handle drawn in full line.

While an embodiment and application has been shown and described, it will be apparent to those skilled in the art that many more modifications are possible without departing from the inventive concepts herein described. The invention, therefore, is not to be restricted except as is necessary by the prior art and by the spirit of the appended claims.

What is claimed as new and desired to be secured by Letters Patent of the United States is:

1. A disposable safety razor comprising an elongated handle and a shaving head coupled to the top of said elongated handle, said elongated handle adapted for secure but releasable engagement with an identical adjacent razor handle, said handle including front and back faces, a first, upwardly directed hook formed on one of said faces, and a second, downwardly directed hook formed on the other of said faces, and also including a resilient latch member formed on one of said faces and a ledge formed on the other of said faces spaced along said handle from said hooks, and wherein said handle and said adjacent handle are releasably secured together by interengagement of said first hook of said handle with said second hook of said adjacent handle, and engagement of said latch member of said handle with said ledge of said adjacent handle, said latch member being yieldable to permit separation of said handles.

2. A razor according to claim 1, wherein said resilient latch member, when engaged with said ledge of said adjacent handle, holds said handles against lateral separation, and also holds said handles in relative longitudinal positions in which said hooks cannot be readily disengaged.

3. A razor according to claim 2, said latch member includes a spring finger integral with said handle adjacent one of said faces and sloping axially and laterally of said handle toward a free end which includes an integrally formed latch portion adjacent the other of said faces.

* * * * *